US007834280B2

(12) United States Patent
Poyner

(10) Patent No.: US 7,834,280 B2
(45) Date of Patent: Nov. 16, 2010

(54) SAFETY SWITCH

(75) Inventor: Julian Poyner, Stockport (GB)

(73) Assignee: Rockwell Automation Limited, Milton Keynes (GB)

( * ) Notice: Subject to any disclaimer, the term of this patent is extended or adjusted under 35 U.S.C. 154(b) by 376 days.

(21) Appl. No.: 12/013,689

(22) Filed: Jan. 14, 2008

(65) Prior Publication Data

US 2008/0223698 A1 Sep. 18, 2008

(30) Foreign Application Priority Data

Mar. 17, 2007 (GB) ..... 0705174.1

(51) Int. Cl.
*H01H 19/00* (2006.01)

(52) U.S. Cl. ..... 200/19.06; 200/43.07

(58) Field of Classification Search ..... 200/19.01, 200/19.02, 19.06, 1 B, 334, 33 R, 43.04, 200/43.07, 61.76; 307/116, 141
See application file for complete search history.

(56) References Cited

U.S. PATENT DOCUMENTS 4,181,829 A * 1/1980 Selas ..... 200/33 R
5,587,569 A * 12/1996 Mohtasham ..... 200/17 R
5,691,517 A * 11/1997 Yamamoto et al. ..... 200/6 A
6,080,943 A * 6/2000 Amonett et al. ..... 200/38 B
6,469,265 B1 * 10/2002 Penix et al. ..... 200/50.32
6,861,597 B2 * 3/2005 Baechle ..... 200/43.04

FOREIGN PATENT DOCUMENTS

DE 3943376 6/1991
WO WO 2006095645 9/2006

OTHER PUBLICATIONS

Extended Search Report.

* cited by examiner

*Primary Examiner*—Edwin A. Leon
*Assistant Examiner*—Vanessa Girardi
(74) *Attorney, Agent, or Firm*—Boyle Fredrickson LLP; William R Walbrun; John M. Miller

(57) ABSTRACT

A safety switch that includes a housing, a first switch, and a second switch. The switch has a two part rod that is axially moveable within the housing. The parts of the rod are co-operable with respect to one another and independently operable to activate one of the first and second switches. A biasing element is arranged to bias the rod parts into contact with a cam arrangement and arranged to bias the rod parts out of engagement with one of the respective switches. The cam arrangement is configured such that rotation of the cam arrangement will move the rod parts thereby activating the switches to allow the safety switch to conduct electricity.

20 Claims, 8 Drawing Sheets

SAFETY SWITCH

CROSS-REFERENCE TO RELATED APPLICATIONS

This application claims priority to Great Britain patent application 0705174.1 filed on Mar. 17, 2007 and the disclosure of which is incorporated herein.

BACKGROUND OF THE INVENTION

The present invention relates to a safety switch.

Safety switches are well known, and are typically used to prevent access to, for example, electromechanical machinery when that machinery is in operation. In a conventional arrangement, the safety switch is mounted on a door post of a machine guard, and an actuator for the safety switch is mounted on a corresponding door. When the door is closed the actuator engages with the safety switch, which in turn closes a set of electrical contacts which allows electricity to be supplied to the machinery. This arrangement ensures that electricity can only be supplied to the machinery when the machine guard door is shut. When the guard door is opened, the actuator disengages from the safety switch, thereby opening the electrical contact and cutting off the supply of electricity to the machinery.

In some instances the set of electrical contacts can become welded together due to the large currents that often flow through the contacts of safety switches. When the contacts weld together, the contacts behave as if they are closed, allowing power to be supplied to the machinery. Even if it is possible to disengage the actuator from the safety switch, the contacts may remain welded together and electricity may still be supplied to the machinery in the machine guard. Thus, if the contacts weld together, power can be supplied to the machinery even when the guard door is open. This can be dangerous, since if the contacts become welded closed, a user can enter the machine guard when the machinery is in operation.

It is an object of the present invention to overcome or substantially mitigate the above mentioned disadvantages.

SUMMARY OF THE INVENTION

According to a first aspect of the present invention there is provided a safety switch having a housing and a first switch and a second switch located within the housing and fixed in position relative to the housing. A rod that is axially moveable within the housing includes a first rod part and a second rod part co-operable with the first rod part. The first rod part and second rod part extend parallel to each other and the first rod part and second rod part are slideable relative to one another in an axial direction. The first rod part is provided with an abutment surface for activating the first switch and the second rod part is provided with an abutment surface for activating the second switch. The safety switch includes at least one biasing element that is arranged to bias the rod parts into contact with a cam arrangement and arranged to bias the rod parts such that the abutment surfaces of the rod parts are biased away from the switches. The cam arrangement is configured such that rotation of the cam arrangement will push the rod parts against the at least one biasing element to bring the abutment surfaces of the rod parts into contact with and activate the switches to allow the safety switch to conduct electricity.

Preferably, the safety switch further comprises a monitoring apparatus arranged to determine a time difference between the activation of the first switch by the abutment surface of the first rod part and the activation of the second switch by the abutment surface of the second rod part. Preferably, the monitoring apparatus is arranged to prevent the safety switch from conducting electricity if the time difference does not approximate a certain value, exceeds a certain value, is below a certain value, or deviates from a certain value. Alternatively, the monitoring apparatus is arranged to synchronise signals received from the switches if the signals are received within a predetermined period of time.

Preferably, the first switch and second switch are pushbutton switches.

Preferably, the first switch and second switch are microswitches.

Preferably, the abutment surface of each rod part extends away from the respective rod part.

Preferably, the first rod part is provided with a guide, and the second rod part is provided with a channel, the channel being co-operable with the guide to allow the first rod part and second rod part to slide relative to one another.

Preferably, the safety switch further comprises a biasing element for each rod part.

Preferably, the biasing element is a spring.

Preferably, each rod part is substantially semi-circular in cross section, such that the rod as a whole is substantially circular in cross-section. Preferably, the rod is substantially cylindrical.

According to a second aspect of the present invention, a safety switch rod is disclosed that includes a first rod part and a second rod part that is co-operable with the first rod part. The first rod part and second rod part extend generally parallel to each other and the first rod part and second rod part are slideable relative to each another in an axial direction. Each rod part is further provided with an abutment surface arranged to engage with a switch.

Preferably, the abutment surface of each rod part extends away from the respective rod part.

Preferably, the first rod part is provided with a guide, and the second rod part is provided with a channel that is co-operable with the guide to allow the first rod part and second rod part to slide relative to one another.

Preferably, each rod part is substantially semi-circular in cross section, such that the rod as a whole is substantially circular in cross-section. Preferably, the rod is substantially cylindrical.

According to another aspect of the present invention, a safety switch is disclosed that includes a housing, a first switch located within the housing and fixed in position relative to the housing, and a cam arrangement provided with a protruding element. The cam arrangement is rotatable by an actuator to bring the protruding element into contact with the switch and to change a state of the switch from a first state to a second state.

Preferably, the first switch is arranged to move from a conducting to a non-conducting state when the protruding element is brought into contact with the first switch. Alternatively, the first switch is arranged to move from a conducting to a non-conducting state when the protruding element is brought into contact with the first switch.

Preferably, the first switch is arranged to override at least one other switch provided in the safety switch when the first switch changes from a first state to a second state.

It is appreciated that the aspects discussed above are not necessary mutually exclusive. It is further appreciated that other aspects will be appreciated from the forthcoming description.

BRIEF DESCRIPTION OF THE DRAWINGS

Embodiments of the present invention will now be described, by way of example only, with reference to the accompanying drawings, in which.

The Figures are schematic representations useful for understanding the present invention, and are not drawn to scale. Identical features appearing in different Figures have been given the same reference numbers. The following detailed description is directed to preferred embodiments of the present invention. It is understood that the claims as presented herein are not to limited thereto.

DETAILED DESCRIPTION

Figure 1A:
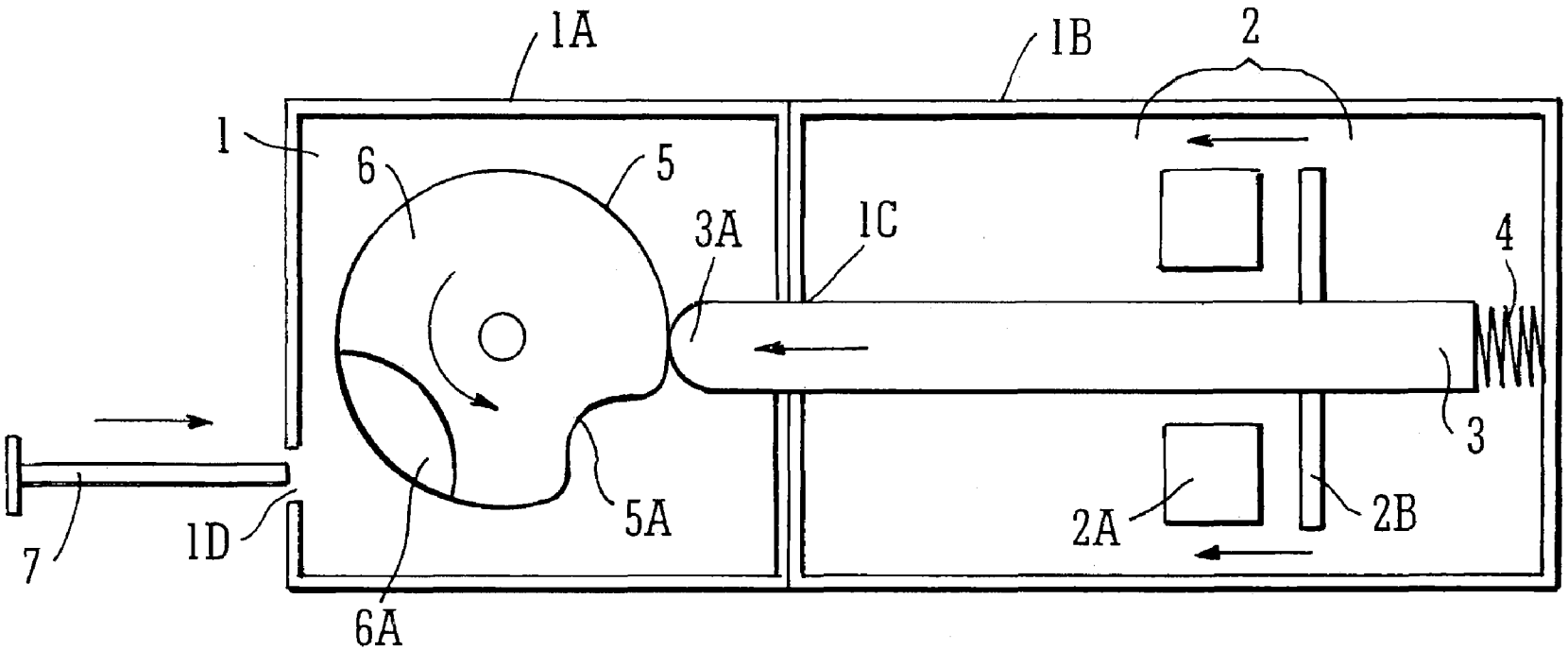
FIGS. 1A and 1B depict a prior art safety switch mechanism.

FIG. 1A is a side view of a prior art safety switch. The safety switch comprises a housing 1, in which is mounted a set of contacts 2. The contacts 2 are conductors which can be brought together to make a circuit or separated to break a circuit. The contacts comprise fixed contacts 2A and moveable contacts 2B. The fixed contacts 2A are fixed in position relative to the housing 1. The moveable contacts 2B are moveable relative to the housing 1, and are fixed to an axially-moveable rod 3. The moveable contacts 2B extend through the axially-moveable rod 3. In some embodiments (not shown), the moveable contacts may also be moveable along a window provided in the axially moveable rod, against the bias of biasing elements provided in the rod. The axially-moveable rod 3 is biased by a spring 4 which serves to bias the moveable contacts 2B toward the fixed contacts 2A. Although the moveable contacts 2B are biased toward the fixed contacts 2A, they are kept apart from one another due to the presence of a cam arrangement 6. The axially-moveable rod 3 is biased by the spring 4 into contact with a cam surface 5 of the cam arrangement 6. The cam surface 5 is shaped so that the contacts 2A, 2B are kept apart until the cam arrangement is made to rotate. Until the cam arrangement 6 is made to rotate, the safety switch therefore acts as a break in a circuit. The safety switch may be electrically connected to electrically powered machinery, and no power can be supplied to the electrically powered machinery when the fixed contacts 2A and moveable contacts 2B are kept apart from one another.

The cam arrangement 6 is provided with a notch 6A for engaging with an actuator 7. The cam surface 5 is provided with an indentation 5A which is dimensioned such that when it is aligned with an end 3A of the axially-moveable rod 3, the axially-moveable rod 3 moves into the first indentation 5A under the bias of the spring 4. When the axially-moveable rod 3 moves into the first indentation 5A under the bias of the spring 4, the fixed contacts 2A and moveable contacts 2B are brought into contact with one another.

The housing 1 is formed from two parts: a first part 1A, in which the cam arrangement 6 is mounted, and a second part 1B, in which the contacts 2 are mounted. The first and second parts 1A, 1B are joined together, but it is possible to rotate the first part 1A relative to the second part 1B (for example, to choose a desired orientation of the first part 1A). The axially moveable rod 3 extends between the first and second housing parts 1A, 1B through an aperture 1C provided between the joined housing parts 1A, 1B. The aperture 1C provides a water tight seal around the axially moveable rod 3, so that the second part of the housing 1B, in which the electrical contacts 2 are located, is watertight. The aperture 1C also provides some support for the axially moveable rod 3 which extends through it.

Figure 1B:
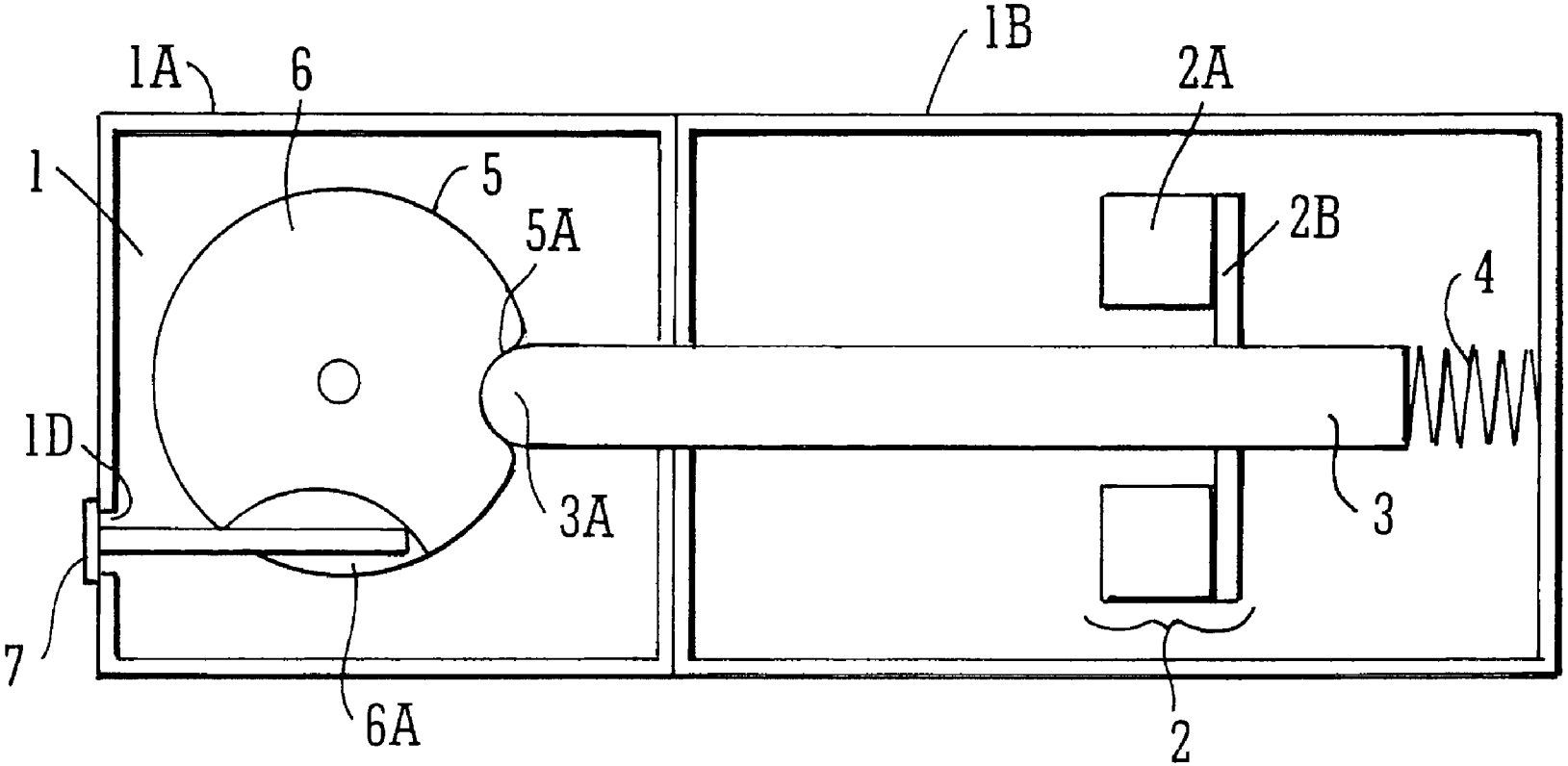

In use, the actuator 7 is inserted through a slot 1D in the housing 1, and brought into engagement with the notch 6A of the cam arrangement 6, causing the cam arrangement 6 and cam surface 5 to rotate in a anti-clockwise or counter-clockwise direction. Full insertion of the actuator 7 causes the indentation 5A of the cam surface 5 to be brought into alignment with the axially-moveable rod 3. The axially moveable rod 3 moves into the indentation 5A, bringing the moveable contacts 2B into electrical connection with the fixed contacts 2A (i.e. the safety switch no longer forms a break in a circuit which it forms a part of). Thus, when the actuator 7 has been inserted into the housing 1, electricity may flow through the contacts 2A, 2B. FIG. 1B shows the safety switch with the actuator 7 fully inserted.

In normal operation, removing the actuator 7 from the housing 1 will cause the cam arrangement 6 and cam surface 5 to rotate in the opposite direction to that described in the previous paragraph (i.e. in a clockwise direction). As the cam surface 5 rotates in the opposite direction, the cam surface 5 pushes the axially moveable rod 3 against the bias of the spring 4, and causes the moveable contacts 2B to be moved away from and out of electrical connection with the fixed contacts 2A. When the actuator 7 is fully removed from the housing 1, the safety switch will return to the state shown in and described with reference to FIG. 1A, i.e. such that the safety switch serves to act as a break in a circuit.

When the moveable contacts 2B are brought into electrical connection with the fixed contacts 2A, the safety switch allows electricity to be supplied to electrically powered machinery to which the safety switch is connected. The current flowing through the contacts 2A, 2B may be high enough to generate a large amount of heat in the contacts 2A, 2B. The large amount of heat can cause the contacts 2A, 2B to become welded to one another. When the contacts 2A, 2B have become welded to one another, the safety switch will conduct electricity regardless of whether the actuator 7 is inserted in the housing 1 or not.

The welding together of the contacts 2A, 2B is detrimental to desired operation of the safety switch. In a conventional arrangement, the safety switch is mounted on a door post of a machine guard, and the actuator 7 for the safety switch is mounted on a corresponding door. If the contacts 2A, 2B are welded together, the safety switch will conduct electricity regardless of whether the actuator 7 is inserted in the housing 1 or not, i.e. machinery within the machine guard will be operable even if the door to the guard is open.

It will be appreciated that the contacts 2A, 2B need not be welded together at all points of electrical connection for a problem to occur. For example, only one side of the moveable contact 2B that extends through the axially-moveable rod 3 may become welded to a part of the fixed contact 2A. Even this partial welding of the contacts 2A, 2B may be enough to result in the safety switch being capable of conducting electricity, even if the actuator 7 is removed from the housing 1. This is because even partial welding together of the contacts 2A, 2B may be enough to fix the axially-moveable rod 3 (or the moveable contacts 2B, if the moveable contacts are moveable relative to the axially moveable rod 3) in position, keeping the contacts 2A, 2B in electrical connection with each other.

It can also be seen from FIG. 1A that if the first part 1A of the housing 1 becomes disconnected from the second part 1B of the housing 1 (for example, due to an impact on the safety switch), the cam arrangement 6 located in the first part 1A of the housing 1 will no longer restrict and control movement of the axially moveable rod 3. If the cam arrangement 6 no longer restricts movement of the axially moveable rod 3, the axially moveable rod 3 will be biased by the spring 4 to the left of FIG. 1A. This causes the moveable contacts 2B to be brought into electrical connection with the fixed contacts 2A, which puts the safety switch into a conducting state. Therefore, if for whatever reason the cam arrangement 6 does not restrict movement of the axially moveable rod 3 (e.g. due to the first part 1A of the housing 1 being disconnected from the second part 1A of the housing 1, or the cam surface 5 becoming worn), the safety switch defaults to an undesired conducting situation. In terms commonly used in the art, this is known as 'failing to closed' or 'failing to danger' referring to the conducting state of the conductors.

Figure 2A:
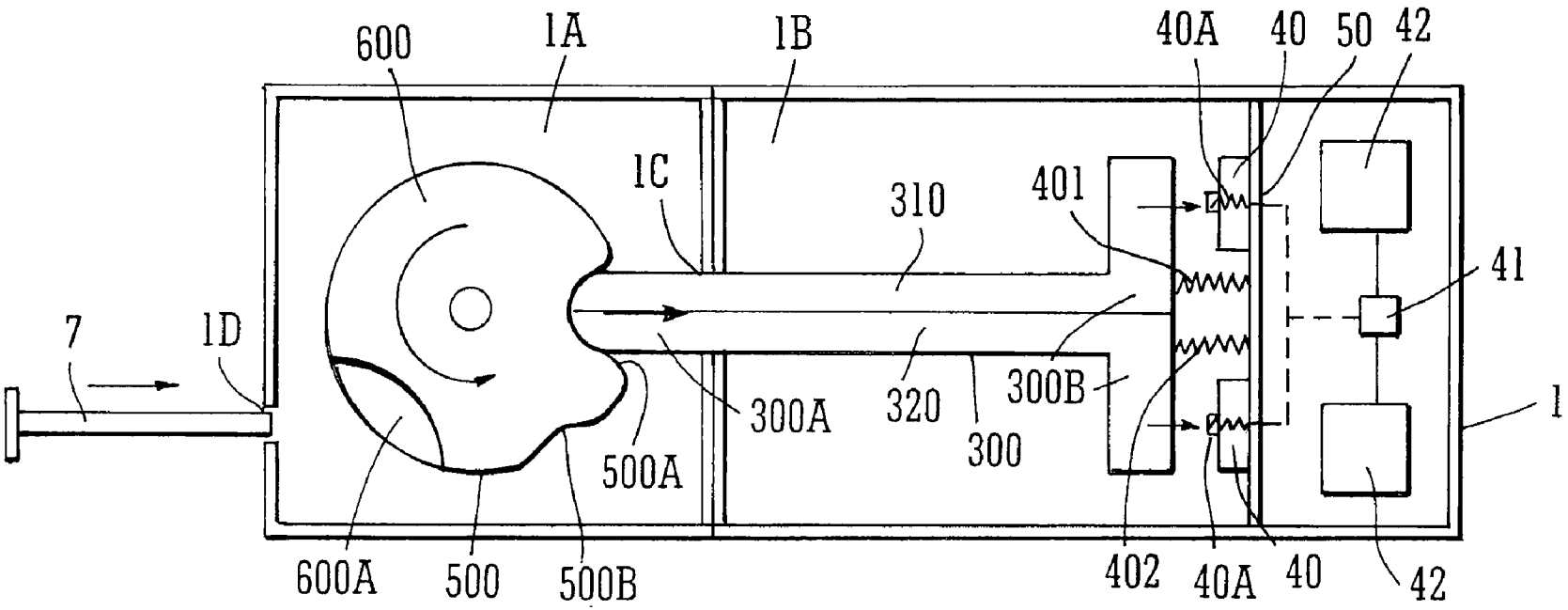
FIGS. 2A to 2D depict a safety switch mechanism according to an embodiment of the present invention.

FIG. 2A depicts a side view of a safety switch according to an embodiment of the present invention. The safety switch comprises a housing 1. A wall 50 is provided in the housing 1, on which are mounted push-button switches 40 (e.g. micro-switches). The push-button switches 40 are spring biased to an open state by switch springs 40A. The switches 40 are in communication with a monitoring apparatus 41. The monitoring apparatus is in turn connected to safety switch relays 42, the activation or deactivation of which controls the conducting state of the safety switch. In one mode of operation, only if both of the switches 40 are activated (i.e. closed) in, for example, a predetermined period of time does the monitoring apparatus 41 activate safety switch relays 42. The wall 50 defines a water tight area at one end of the housing, in which the monitoring apparatus 41 and switch relays 42 are located.

Figure 2B:
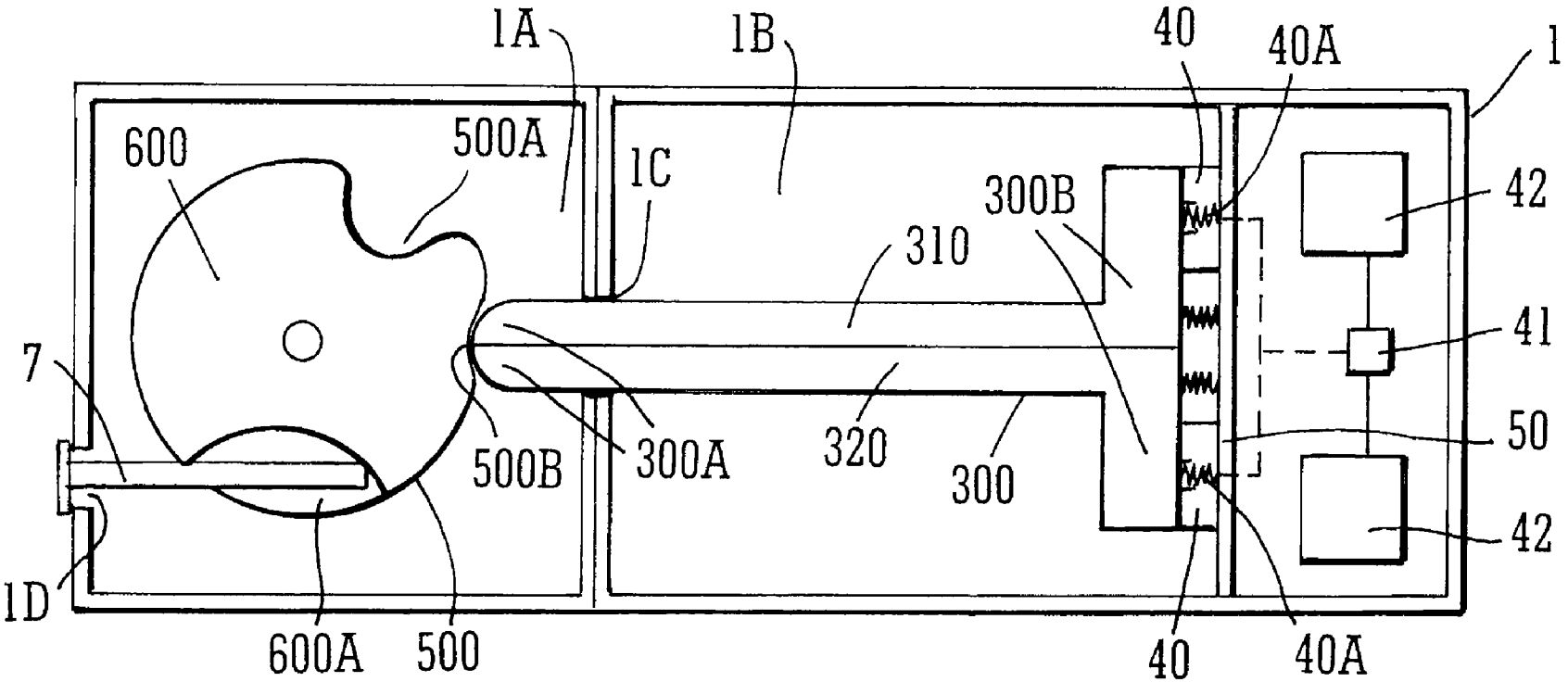
Figure 2C:
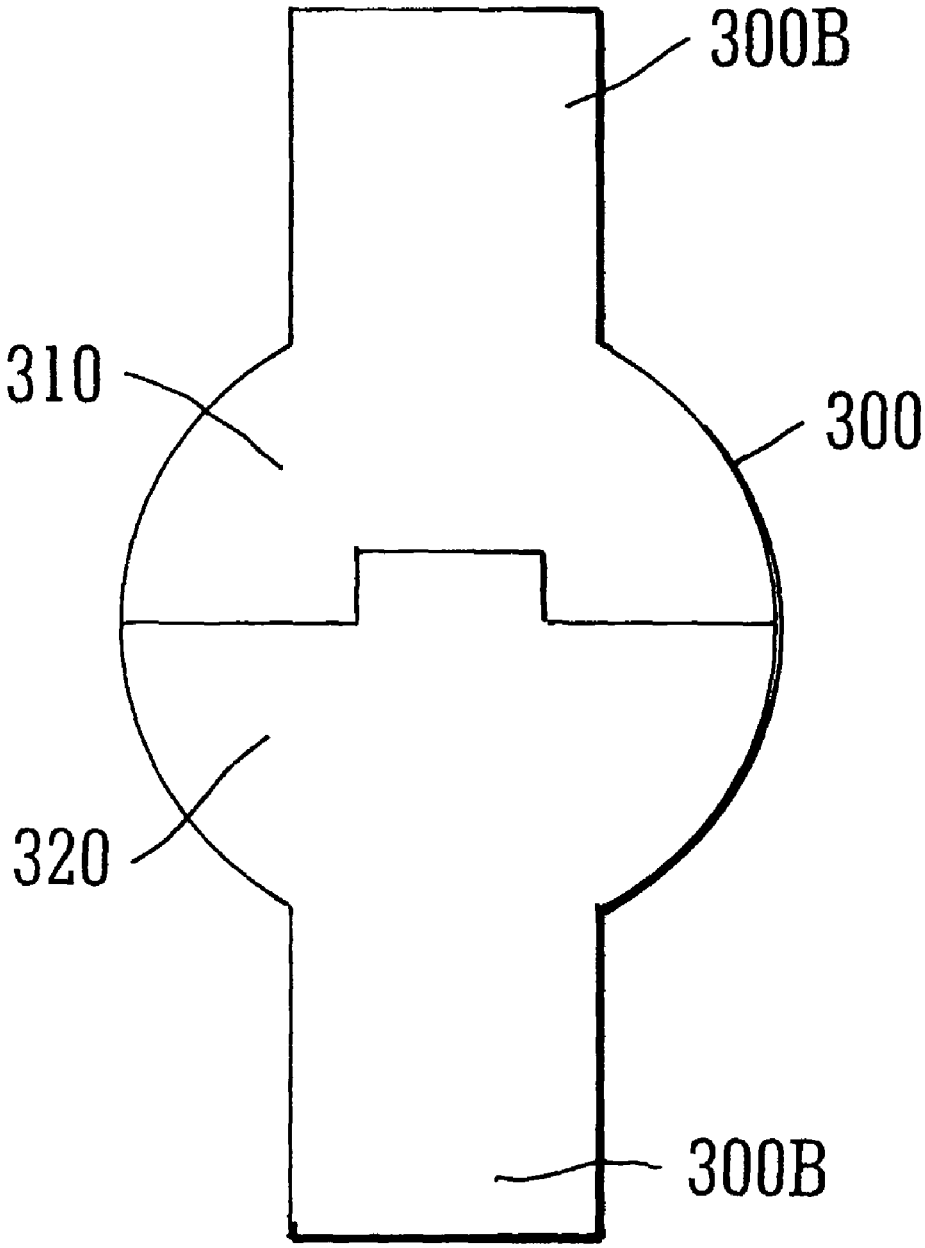

The safety switch is also provided with an axially moveable rod 300. The axially-moveable rod 300 comprises two parts, a first rod part 310 and a second rod part 320. An end view of the first rod part 310 and second rod part 320 is shown in FIG. 2C. The first rod part 310 and second rod part 320 are substantially semi-circular in cross section. Together, the first rod part 310 and second rod part 320 form an axially-moveable rod 300 that is generally circular in cross-section and cylindrical in shape. The first rod part 310 and second rod part 320 are co-operable, in that they are slideable relative to one another in an axial direction. One of the rod parts is provided with a rib or guide 303, and the other rod part is provided with a groove or channel 305. The channel 305 is co-operable with the guide 303 to allow the first rod part 310 and second rod part 320 to slide relative to one another.

Referring now to FIG. 2A, each rod part 310, 320 is provided with an integral abutment surface 300B, which is moveable relative to the housing 1 (since the rod parts 310, 320 themselves are moveable relative to the housing 1). The rod parts 310, 320 are moveable to bring the abutment surfaces 300B into contact with the switches 40, to activate the switches 40. Each rod part 310, 320 is individually biased by a spring 401, 402 which serves to bias the abutment surface 300B of each rod part away from the switches 40, such that the safety switch serves to act as a break in a circuit. The safety switch may be electrically connected to electrically powered machinery, and no power can be supplied to the electrically powered machinery when the abutment surfaces 300B and switches 40 are biased apart from one another.

The axially-moveable rod 300 is biased by the springs 401, 402 into contact with a cam surface 500 of a cam arrangement 600. The cam surface 500 is moveable by rotation of the cam arrangement 600. Rotation of the cam arrangement 600 causes the rod parts 301, 302 of the axially-moveable rod 300 to move in an axial direction. The cam arrangement 600 is provided with a notch 600A for engaging with an actuator 7. The cam surface 500 has two indentations, a first indentation 500A and a second indentation 500B. The first indentation 500A is dimensioned such that when it is aligned with an end 300A of the axially-moveable rod 300, the parts 310, 320 of the axially-moveable rod 300 move into the first indentation 500A under the bias of the springs 401, 402. When the rod parts 310, 320 move into the first indentation 5A under the bias of the springs 401, 402, the abutment surfaces 300B and switches 40 are biased apart from one another.

It can be seen that the housing 1 is formed from two parts: a first part 1A, in which the cam arrangement 600 is mounted, and a second part 1B, in which the switches 40 are mounted. The first and second parts 1A, 1B are joined together (but can be rotated relative to one another, as mentioned above). The axially moveable rod 300 extends between the first and second housing parts 1A, 1B through an aperture 1C provided between the joined housing parts 1A, 1B. The aperture 1C provides a seal around the axially moveable rod, to reduce the ingress of dirt into the second part of the housing 1B, in which the switches 40 are located. The aperture 1C also provides some support for the axially moveable rod 300 which extends through it. Preferably the switches 40 are immersable in water (e.g. the switches 40 maybe IP67 switches), so that even if water gets through the aperture 1C, for example along the interface between the two rod parts 310, 320, the switches can still function.

When the actuator 7 is inserted through a slot 1D in the housing 1, and brought into engagement with the notch 600A of the cam arrangement 600, the cam arrangement 600 and cam surface 500 rotate in an counter clockwise or anti-clockwise direction. Insertion of the actuator 7 into the slot 1D causes rotation of the cam surface 500, which causes the axially-moveable rod 300 to move against the bias of the springs 401, 402. Full insertion of the actuator 7 causes the axially-moveable rod 300 to move to the right with respect to FIG. 2*a*, bringing the abutments surfaces 300B into contact with the switches 40 which causes the switches to be activated, i.e. the safety switch no longer forms a break in a circuit which it forms a part of. When the actuator is fully inserted, the second indentation 500B is brought into alignment with the axially-moveable rod 300. The second indentation 500B is dimensioned such that when it is aligned with the end 300A of the axially-moveable rod 300, the axially-moveable rod 3 moves into the second indentation 500B under the bias of the springs 401, 402. The second indentation 500B is not as deep as the first indentation 500A, and is shaped so that the axially-moveable rod 300 prevents the cam arrangement 600 from easily rotating, while still keeping the abutment surfaces 300B in contact with the switches 40. Thus, when the actuator 7 has been inserted into the housing 1, the safety switch is able to supply electricity to apparatus (e.g. electrically operated machinery) to which it is connected. FIG. 2B shows the safety switch with the actuator 7 fully inserted.

In normal operation, removing the actuator 7 from the housing 1 will cause the cam arrangement 600 and cam surface 500 to rotate in the opposite direction to that described in the previous paragraph (i.e. in a clockwise direction). As the cam surface 500 rotates in the opposite direction, the axially moveable rod 300 is moved to the left of FIG. 2B, moving the abutment surfaces 300B away from and out of contact with the switches 40. This causes the switches to be deactivated. When the actuator 7 is fully removed from the housing 1, the safety switch will return to the state shown in and described with reference to FIG. 2A, i.e. such that the safety switch serves to act as a break in a circuit.

It can be seen from FIG. 2A that if the first part 1A of the housing 1 becomes disconnected from the second part 1B of the housing 1 (for example, due to an impact on the safety switch), the cam arrangement 600 located in the first part 1A of the housing 1 will no longer restrict and control movement of the axially moveable rod 3. If the cam arrangement 600 no longer restricts movement of the axially moveable rod 300, the axially moveable rod 300 will be biased by the springs 401, 402 to the left of FIG. 2A. This causes the abutment surfaces 300B to be moved away from and out of contact with the switches 40, which causes the switches to deactivate (i.e. open), putting the safety switch into a non-conducting state. Therefore, if for whatever reason the cam arrangement 600 does not restrict movement of the axially moveable rod 300 (e.g. due to the first part 1A of the housing 1 being disconnected from the second part 1A of the housing 1, or the cam surface 500 becoming worn), the safety switch defaults to a non-conducting state or situation. In terms commonly used in the art, the switch is 'fail safe' or 'fail to open'. This is in stark contrast to the safety switch of FIG. 1A, which fails to danger or a conducting or closed state if the cam arrangement 600 does not restrict movement of the axially moveable rod 300.

It will be seen from FIGS. 2A and 2B that when the cam arrangement 600 is rotated, one of the rod parts 310, 320 may move before the other rod part 310, 320 since they are slideable relative to one another. This is due to the shape of the cam surface 500 and the way in which it interacts with the ends 300A of the rod parts 310, 320. Since the rod parts 310, 320 may move at different times, the abutment surfaces 300B of the rod parts 310, 320 may come into contact with and activate the switches 40 at different times. This may not significantly affect the operation of the safety switch since electricity may only flow though the switch when both switches 40 are activated. An optional monitoring apparatus 41 can be used to synchronise input signals received from the activated switches 40 to ensure that the safety switch relays 42 are only activated if the switches are activated (i.e. to send input signals to the monitoring apparatus) within a predetermined period of time, as described below.

In the prior art safety switch of FIG. 1A, if any part of the moveable contacts 2B became welded to the fixed contacts 2A, the safety switch would be left in a conducting state, i.e. the safety switch would be able to conduct electricity even if the actuator 7 was removed from the housing 1. The use of switches 40 in the safety switch of FIG. 2A, as opposed to contacts in FIG. 1A, reduces the possibility of parts of the safety switch welding together to cause the safety switch to default to a conducting state. This is because the axially moveable rod 300 is not provided with contacts, but with abutment surfaces 300B. Although the abutment surfaces 300B are moveable to activate the switches 40, no current flows through the abutment surfaces 300B or any other part of the axially moveable rod 300. All current flow will be controlled by the activation or deactivation of the switches 40. Although it is possible that one of these switches 40 could become welded closed and stuck in a conducting state, the monitoring apparatus 41 does not allow the safety switch to conduct electricity unless both switches 41 are in a conducting state (e.g. welded closed or activated). The use of multiple switches therefore provides some redundancy in the operation of the safety switch.

Figure 2D:
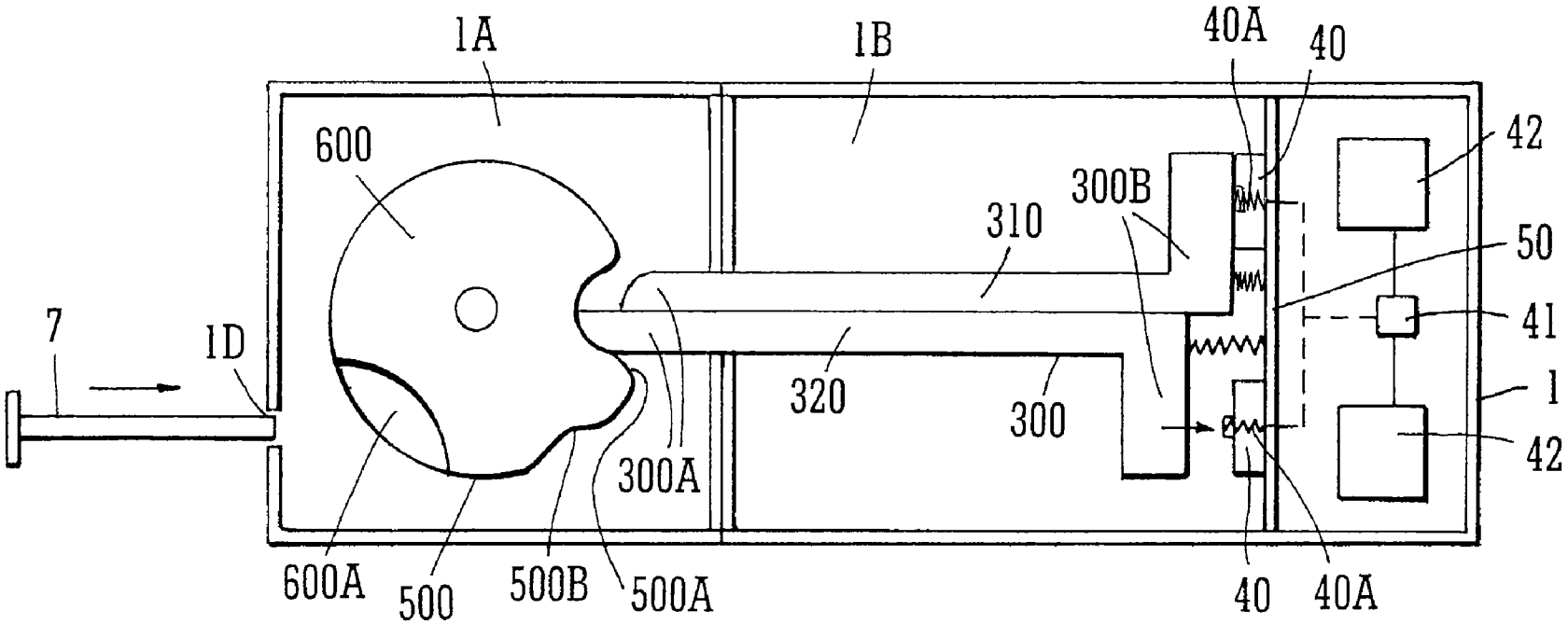

It is possible that one rod part 310 may become stuck in a position which causes one of the switches 40 to be activated. For example, this may happen due to a build of dirt in the safety switch, or due to the abutment surface 300B of the rod part becoming stuck to a surface of the switch 40. It can be seen from FIG. 2D that if the abutment surface 300B of the first rod part 310 is stuck in a position which causes activation of one of the switches 40, the second rod part 320 is free to slide away from and deactivate the other switch 40. If one of the switches is deactivated 40, the monitoring apparatus 41 prevents the safety switch from conducting electricity. Again, this is a fail to safe or non-conducting feature. If only one of the switches 40 are activated by a rod part 310 stuck in position, the safety switch does not default to a situation where it is able to conduct electricity. This is in stark contrast to the prior art safety switch of FIG. 1A, where if the axially moveable rod 3 were stuck in a position which brought the fixed 2A and moveable 2B contacts together, the safety switch would be able to conduct electricity. Instead, the safety switch of FIGS. 2A to 2D defaults to a position where one of the abutment surfaces 300B is moved away from the switch 40, thereby preventing the safety switch from conducting electricity.

In summary, in prior art safety switches, if the contacts fail (i.e. they become welded together), or the cam arrangement fails (e.g. becomes worn, is removed etc.), the safety switch fails to a state wherein the switch defaults to a situation where it is able to conduct electricity. In contrast, the safety switch of the present invention fails to a non-conducing state if the cam arrangement 600 fails, or if a part 310 of the axially moveable rod 300 is stuck in a position which activates one of the switches 40.

The use of an axially-moveable rod comprising two relatively slideable parts has been described to reduce the possibility of a safety switch failing to closed due to, for example, a part of the axially moveable rod being stuck in position. However, the use of an axially-moveable rod having two parts has other advantages. For example, it has already been described how, due to the use of two relatively slideable rod parts and a rotatable cam surface, the slideable rod parts may move in an axial direction at different times. An optional monitoring apparatus can be included which monitors the times at which these slideable rod parts move, for example by monitoring the time at which switches are activated by abutment surfaces. In particular, times between rod part movements can be monitored, for example by measuring the times between switches being activated. If these times do not satisfy a threshold or certain value, exceed a certain value, are below a certain value or deviate from a certain value, problems with the safety switch can be determined. For example, referring to FIG. 2A, if the cam surface 500 of the switch becomes worn in certain places, the parts 310 and 320 of the axially-moveable rod 300 may move to a greater or lesser extent, or move at different times, when compared with the use of an unworn cam surface 500. An optional monitoring apparatus connected to the switches 40 can detect a corresponding change in time (e.g. increase, decrease or deviation from previously known times for a new cam surface 500) between the abutment surfaces 300B of each rod part 310, 320 being brought into contact with and activating the switches 40. The monitoring apparatus may provide a warning if this situation occurs (e.g. audible, tactile, or visible such as an LED indicating a fault may be illuminated). The monitoring apparatus may default to a state where it prevents the switch from conducting electricity when the monitored time increases, decrease or deviates, etc., thus ensuring that the safety switch fails to non-conducting. If the monitoring apparatus prevents the safety switch from conducting electricity, the safety switch can be opened up for repair or simply replaced.

Alternatively, it will be appreciated that the optional monitoring apparatus 41 may be used to synchronise input signals received at different times from the switches 40. For example, the switches 40 may be activated at slightly different times in normal operation. If the switches are found to be activated within a predetermined period of time (e.g. 100 msecs, 200 msecs, or any suitable time period), the monitoring apparatus can synchronise the signals received from the switches 40 and activate the safety switch relays 42. If the signals are not received within a predetermined period, the monitoring apparatus can default to the situation discussed above, i.e. where it prevents the safety switch from conducting electricity, and, for example, provides a warning of a possible fault with the safety switch.

The monitoring apparatus can monitor the times between rod part movements, or switches activated in any number of ways. For example, the monitoring apparatus can detect when a first switch is activated (e.g. by monitoring the current flow in a circuit which the first switch is a part of), and count the time, using an internal clock, before the second switch is activated (e.g. by monitoring the current flow in a circuit which the first switch is a part of). It will be appreciated that any suitable monitoring means may be used, and that these monitoring means may work in any suitable manner.

Figure 3A:
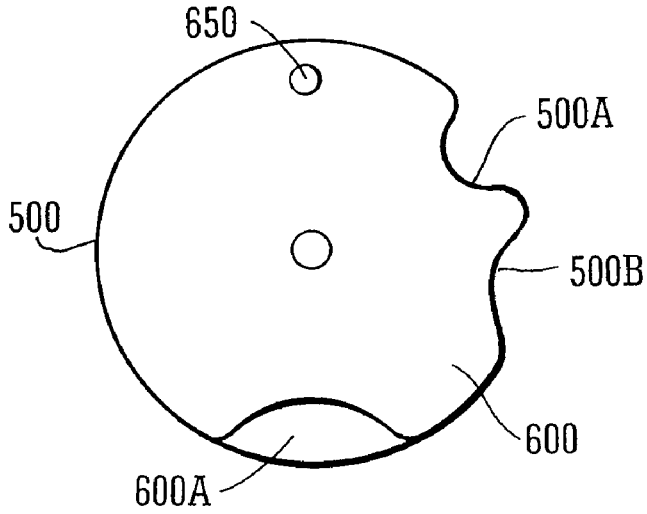
FIGS. 3 and 4 depict further embodiments of the present invention.
Figure 3B:
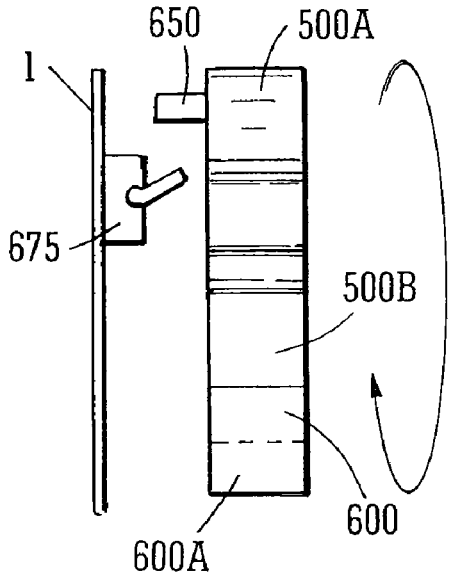

Although unlikely, it is possible that the abutment surfaces 300B of both rod parts 310, 320 could become stuck in a position where both switches 40 are activated, even if the actuator 7 is removed from the safety switch. For example, dirt in the second part 1B of the housing could cause the rod parts 310, 320 to become stuck in position. If this were the case, the safety switch would remain in a conducting state even if the actuator was removed from the housing, which is clearly undesirable. A solution to this problem is depicted in FIGS. 3*a* and 3*b*. FIG. 3*a* shows the cam arrangement 600 of FIG. 2, albeit with some modification. The cam arrangement 600 is now provided with a protruding element 650. FIG. 3*b* depicts the cam arrangement 600 end-on. The cam arrangement 600 is shown in relation to a redundancy switch 675. The redundancy switch 675 is attached to the housing 1, and may be a micro-switch or any other suitable switch. It can be seen that if the cam arrangement 600 is rotated, for example by removal of the actuator from the safety switch, the protruding element 650 will be moved towards the redundancy switch 675 and then on to activate the redundancy switch 675 (i.e. changing the state of the redundancy switch 675 from a first state to a second state, for example from a conducting state to a non-conducting state, or from a non-conducting to a conducting state). Activation of the redundancy switch 675 can therefore be used to identify when the actuator has been removed from the safety switch. Referring back to FIG. 2D, even if both rod parts 310, 320 become stuck in a position where both switches 40 are activated, activation of redundancy switch 675 can be used to override the switches 40. Therefore, even if both rod parts 310, 320 became stuck in a position where both switches 40 are activated, the safety switch will still fail to a non-conducting state through the inclusion of cam arrangement 600 and redundancy switch 675 shown in FIGS. 3*a* and 3*b*.

The redundancy switch 675 may override the switches 40 electronically or mechanically. In some safety switches, in may not be practical to incorporate a redundancy switch 675 which utilises electronic override principles, since the safety switch may not comprise any electronics. However, the redundancy switch 675 may be used in, and be particularly suited to, switches which do incorporate electronics (for example, the safety switch according to embodiments of the present invention). It will be appreciated that the cam arrangement 600 and redundancy switch 675 combination shown in FIGS. 3*a* and 3*b* may be used in safety switches other than that shown in FIGS. 2*a* to 2*d*.

Figure 4:
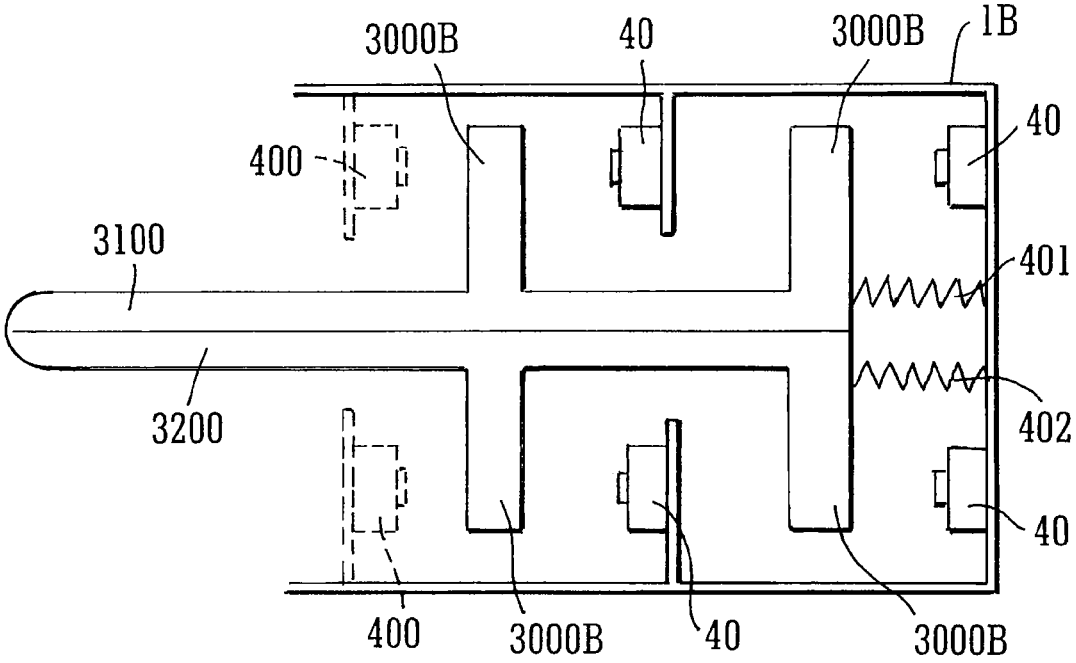

In the embodiments described above, the two rod parts 310, 320 are each provided with a single abutment surface 300B moveable to activate a switch. It will be appreciated that other configurations are possible, for example where each rod part is provided with more than one abutment surface, moveable to activate more than one switch. FIG. 3 depicts such an alternative configuration. FIG. 4 illustrates a part of a safety switch according to another alternative configuration. Two rod parts are provided 3100, 3200, each of which is provided with two abutment surfaces 3000B. The abutment surfaces 3000B are disposed along the length of the rod parts, and extend away from the rod parts in an axial direction. The rod parts 3100, 3200 are moveable to bring the abutment surfaces 3000B into contact with switches 40. It can be seen that, in comparison with FIG. 2D, four switches maybe activated, as opposed to two. The extra switches may provide some redundancy, or provide extra functionality. Further switches 400 are shown in outline, and these switches 400 maybe activated if the abutment surfaces 3000B are moved to engage with them. For example, these switches 400 may be activated when the removal of the actuator from the safety switch causes the abutment surfaces 3000B to be brought into contact with the switches 400. Activation of the switches 400 may therefore be used to show that the actuator has been removed from the safety switch (e.g. by activation of a light), or for any other desired purpose.

In the embodiments described above, the first rod part and second rod part are co-operable via a guide and channel to slide relative to one another in an axial direction. Any co-operable configuration which allows the first rod part and second rod part to co-operate to slide relative to one another in an axial direction may be employed. For example, the first rod part may be interlocked with the second rod part, so that the first rod part and second rod part can slide relative to each other, but cannot be easily detached from one another. One or both of the first and second rod parts may be provided which one or more channels or other indentations. The channels may run along the faces of the first and second rod parts that co-operate with one another. The channels may allow dirt to escape from the interface between the two rod parts, and reduce or eliminate the possibility of the rod parts becoming stuck to one another due to the build up of dirt.

In the embodiments described above, the springs 401, 402 serve to bias the abutment surface 300B of each rod part away from the switches 40. It will be appreciated that the switch springs 40A provided in the switches 40 also serve this purpose. The switches may be provided with leaf springs which also serve to bias the abutment surface 300B of each rod part away from the switches 40.

In FIG. 1, the moveable contacts 2B and fixed contacts 2A have been generically referred to as conductors. Any suitable conductor may be used, for example gold or copper. Depending on the implementation of the invention, any suitable configuration of conductors may be used. For example, in the above embodiments, the fixed contact 2A is actually a first and second fixed conductor. The moveable conductor 2B of the axially moveable rod 3 is brought into electrical connection with the first and second fixed conductors to bridge a gap between the first and second fixed conductors and to allow the safety switch to conduct electricity. A variety of other configurations are envisioned In the embodiments shown in the Figures, the cam arrangement 600 is shown as being in the plane of the page. However, it will be appreciated that the cam arrangements 600 will function equally well if it (or the housing part 1A that contains it) was rotated 90° to make the cam arrangement extend perpendicularly from the page. Another slot could be provided in the first part 1A of the housing 1 to accommodate use of the cam arrangement 600 in this configuration.

A new safety switch may be constructed and/or supplied with an axially-moveable rod according to an embodiment of the present invention. Alternatively, the axially-moveable rod according to an embodiment of the present invention may be retro-fitted to safety switches designed to accommodate the axially moveable rod (for example, as a replacement for a damaged rod).

It is appreciated that the embodiments described above have been given by way of example only. Various modifications may be made to those and other embodiments without departing from the invention as defined by the claims, which follow.

What is claimed is:

1. A safety switch comprising:

a housing;

a first switch and a second switch located within the housing and fixed in position relative to the housing;

a rod, axially moveable within the housing, the rod comprising a first rod part and a second rod part co-operable with the first rod part, and the first rod part and second rod part being slideable relative to one another in an axial direction, the first rod part being provided with an abutment surface for activating the first switch and the second rod part being provided with an abutment surface for activating the second switch;

at least one biasing element, arranged to bias the rod parts into contact with a cam arrangement and arranged to bias the rod parts such that the abutment surfaces of the rod parts are biased away from the respective switches, the cam arrangement being configured such that rotation of the cam arrangement pushes the rod parts against the at least one biasing element to bring the abutment surfaces of the rod parts into contact with and activate the switches to allow the safety switch to conduct electricity.

2. The safety switch as claimed in claim 1, wherein each of the first switch and second switch are one of pushbutton switches or microswitches.

3. The safety switch as claimed in claim 1, wherein each rod part includes a shaft portion which extends in a generally parallel direction with the shaft portion of the other rod part and the abutment surface of each rod part extends away from the respective shaft portion.

4. The safety switch as claimed in claim 1, wherein the first rod part is provided with a guide, and the second rod part is provided with a channel that is co-operable with the guide to allow the first rod part and second rod part to slide relative to one another.

5. The safety switch as claimed in claim 1, further comprising another biasing element such that each rod part is independently biased.

6. The safety switch as claimed in claim 1, wherein the biasing element is a spring.

7. The safety switch as claimed in claim 1, wherein each rod part has a generally semi-circular in cross section, such that a cross-section of the rod is generally circular.

8. The safety switch as claimed in claim 7w, wherein the rod is substantially cylindrical.

9. The safety switch as claimed in claim 1, further comprising a monitoring apparatus arranged to determine a time difference between the activation of the first switch by the abutment surface of the first rod part and the activation of the second switch by the abutment surface of the second rod part.

10. The safety switch as claimed in claim 9, wherein the monitoring apparatus is arranged to prevent the safety switch from conducting electricity if the time difference: exceeds a certain value, is below a certain value or deviates from a certain value.

11. The safety switch as claimed in claim 9, wherein the monitoring apparatus is arranged to synchronize signals received from the switches if the signals are received within a predetermined period of time.

12. A safety switch rod, comprising:

a first rod part and a second rod part co-operable with the first rod part, the first rod part and second rod part being generally mirror images of one another along a longitudinal axis of the first rod part and the second rod part and extending parallel to each other along the longitudinal axis, and the first rod part and second rod part being slideable relative to each another in an axial direction along the longitudinal axis, each rod part being provided with an abutment surface that extends radially outward with respect to the longitudinal axis and arranged to engage with a switch.

13. The safety switch rod as claimed in claim 12, wherein the abutment surface of each rod part extends away from the respective rod part so that the abutment surfaces of the first rod part and the second rod part extend in generally opposite directions from the longitudinal axis.

14. The safety switch rod as claimed in claim 12, wherein the first rod part is provided with a guide, and the second rod part is provided with a channel, the channel and guide configured to be co-operable to allow the first rod part and second rod part to slide relative to one another.

15. The safety switch rod of claim 12 incorporated into a safety switch having a two-part housing and a cam arrangement configured to cooperate with an actuator such that operation of a cam translates the rod against a biasing force so that the safety switch can conduct electricity.

16. The safety switch rod as claimed in claim 12, wherein each rod part is generally semi-circular in cross section, such that the rod as a whole is substantially circular in cross-section.

17. The safety switch rod as claimed in claim 16, wherein the rod is substantially cylindrical.

18. A safety switch comprising:

a housing;

a first switch located within the housing and fixed in position relative to the housing;

a plunger having a first part and a second part that are similarly shaped and moveable relative to one another, each of the first art and the second part of the plunger being movable along an axis between a first position and a second position and being biased to one of the first position and the second position;

a cam arrangement oriented to manipulate movement of the first part and the second part of the plunger between the first position and the second position against the bias and provided with a protruding element that extends in a direction generally normal to a direction of rotation of the cam arrangement, the cam arrangement being rotatable by an actuator to bring the protruding element into contact with the switch and to change a state of the switch from a first state to a second state independent of the first part and the second part of the plunger being in the first position or the second position with respect to the cam arrangement.

19. The safety switch as claimed in claim 18, wherein the first switch is arranged to change between a conducting to a non-conducting state when the protruding element is brought into and out of contact with the first switch.

20. The safety switch as claimed in claim 18, wherein the first switch is arranged to override at least one other switch provided in the safety switch and whose condition is determined b at least one of the first part and the second part of the plunger being in one of the first position and the second position when the first switch changes between the first state and the second state.

* * * * *